US010144563B1

(12) United States Patent
Caruso

(10) Patent No.: US 10,144,563 B1
(45) Date of Patent: Dec. 4, 2018

(54) AEROSOL CANISTER CLIP CAP ASSEMBLY

(71) Applicant: Avanti USA Ltd., Tonawanda, NY (US)

(72) Inventor: Albert P. Caruso, Tonawanda, NY (US)

(73) Assignee: Avanti USA, Ltd., Tonawanda, NY (US)

( * ) Notice: Subject to any disclaimer, the term of this patent is extended or adjusted under 35 U.S.C. 154(b) by 0 days.

(21) Appl. No.: 15/714,209

(22) Filed: Sep. 25, 2017

(51) Int. Cl.
*B65D 83/00* (2006.01)
*B65D 51/24* (2006.01)
*B65D 83/38* (2006.01)

(52) U.S. Cl.
CPC ..... *B65D 51/242* (2013.01); *B65D 83/388* (2013.01)

(58) Field of Classification Search
CPC .... A45F 2200/0566; A45F 5/021; A45F 5/02; B65D 83/388; B65D 83/384; Y10T 24/1394; Y10T 24/1388
See application file for complete search history.

(56) References Cited

U.S. PATENT DOCUMENTS 3,160,304 A 12/1964 Peacock
3,450,313 A 6/1969 Jonas
4,044,922 A * 8/1977 Bordelon ..... B65D 83/384 222/183
5,348,193 A * 9/1994 Bruckner ..... B65D 83/384 222/175
5,366,118 A * 11/1994 Ciammitti ..... B65D 83/386 222/153.1
5,472,317 A * 12/1995 Field ..... A61M 5/14244 224/271
5,531,359 A * 7/1996 Winner ..... B65D 83/384 222/153.11
5,628,432 A 5/1997 Mosley
5,819,379 A * 10/1998 Van Hout ..... A41F 9/007 24/182
6,105,923 A * 8/2000 Robertson ..... A45F 5/02 224/257
6,665,909 B2 * 12/2003 Collins ..... A45F 5/02 24/3.1
6,978,517 B2 * 12/2005 Collins ..... A45F 5/02 24/3.1
7,063,244 B2 * 6/2006 Lee ..... A45F 5/02 224/271
D553,002 S 10/2007 Petek
7,757,906 B2 7/2010 Barry
D735,051 S 7/2015 Conway et al.
9,387,976 B2 * 7/2016 Geis ..... B65D 83/384
9,505,015 B2 11/2016 Conway et al.
2003/0141330 A1 7/2003 McDonald et al.
2008/0047977 A1 2/2008 Larsen et al.

* cited by examiner

*Primary Examiner* — Adam Waggenspack
(74) *Attorney, Agent, or Firm* — Simpson & Simpson PLLC

(57) ABSTRACT

A clip cap assembly for securing an aerosol canister, including a cap having a top, a lateral side connected to the top and having a radially inward facing surface arranged to engage the aerosol canister, an opening, and a first flange extending downwardly from the top and forming a first surface in the opening, and a clip, including an arm having a first end and a second end, and a plug extending from the second end and engaged in the opening, the plug having a second surface arranged proximate the first surface, and a prong including a top surface, a bottom surface, and an end surface.

18 Claims, 8 Drawing Sheets

AEROSOL CANISTER CLIP CAP ASSEMBLY

TECHNICAL FIELD

The invention relates generally to a cap for an aerosol canister, and, more specifically, to a cap having a clip that can be assembled to an aerosol canister.

BACKGROUND

Cases for aerosol or spray canisters typically include an actuator to engage the stem of the canister in order to dispel the canister's contents. There are a variety of aerosol dispensers that are used in many applications which include dispensing perfume, air fresheners, personal hygiene products, covering an article with a coat of paint, and dispensing cleaning products, amongst others. One specific application for an aerosol dispenser is as a personal defense device that, for example, directs a chemical repellant spray towards a potential human or animal threat.

Typical aerosol canisters come in a cylindrical shape with no way of securing it to the user's body. With respect to personal defense devices, easy access to dispensing the contents of the canister is crucial to ensure the safety of the user when a threat presents itself. However, the reason personal defense devices are effective is because their chemical contents are indiscriminately extremely painful to anyone who comes into contact with it. Thus, it is important that the user has quick access to the canister without having to carry it in hand.

Therefore, there is a long-felt need for an improved clip cap assembly for an aerosol or spray canister that can be easily attachable to a user's clothing such that it is easily accessible.

SUMMARY

According to aspects illustrated herein, there is provided a clip cap assembly for securing an aerosol canister, comprising a cap, including a top, a lateral side connected to the top and having a radially inward facing surface arranged to engage the aerosol canister, an opening, and a first flange extending downwardly from the top and forming a first surface in the opening, and a clip, including an arm having a first end and a second end, and a plug extending from the second end and engaged in the opening, the plug having a second surface arranged proximate the first surface, and a prong including a top surface, a bottom surface, and an end surface.

According to aspects illustrated herein, there is provided a clip cap assembly for securing an aerosol canister, comprising a cap, including a top, a lateral side connected to the top and having a radially inward facing surface arranged to engage the aerosol canister, and an opening having a first surface, and a clip, including an arm having a first end and a second end, and a plug extending from the second end and engaged in the opening, the plug having a second surface arranged proximate the first surface, and a prong including a top surface, a bottom surface, an end surface, and a flexible tongue.

These and other objects, features, and advantages of the present disclosure will become readily apparent upon a review of the following detailed description of the disclosure, in view of the drawings and appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the claims.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments. The assembly of the present disclosure could be driven by hydraulics, electronics, and/or pneumatics.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims. The term "approximately" is intended to mean values within ten percent of the specified value.

Figure 1:
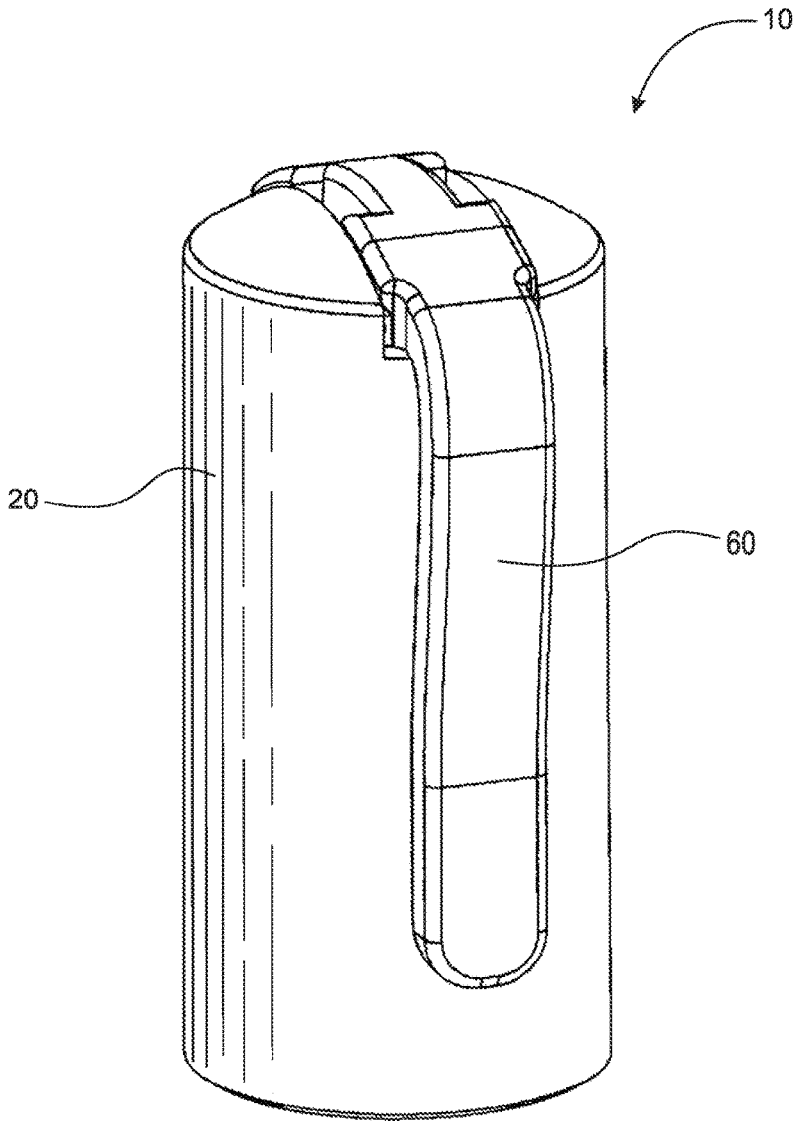
FIG. 1 is a front perspective view of a clip cap assembly.
Figure 2:
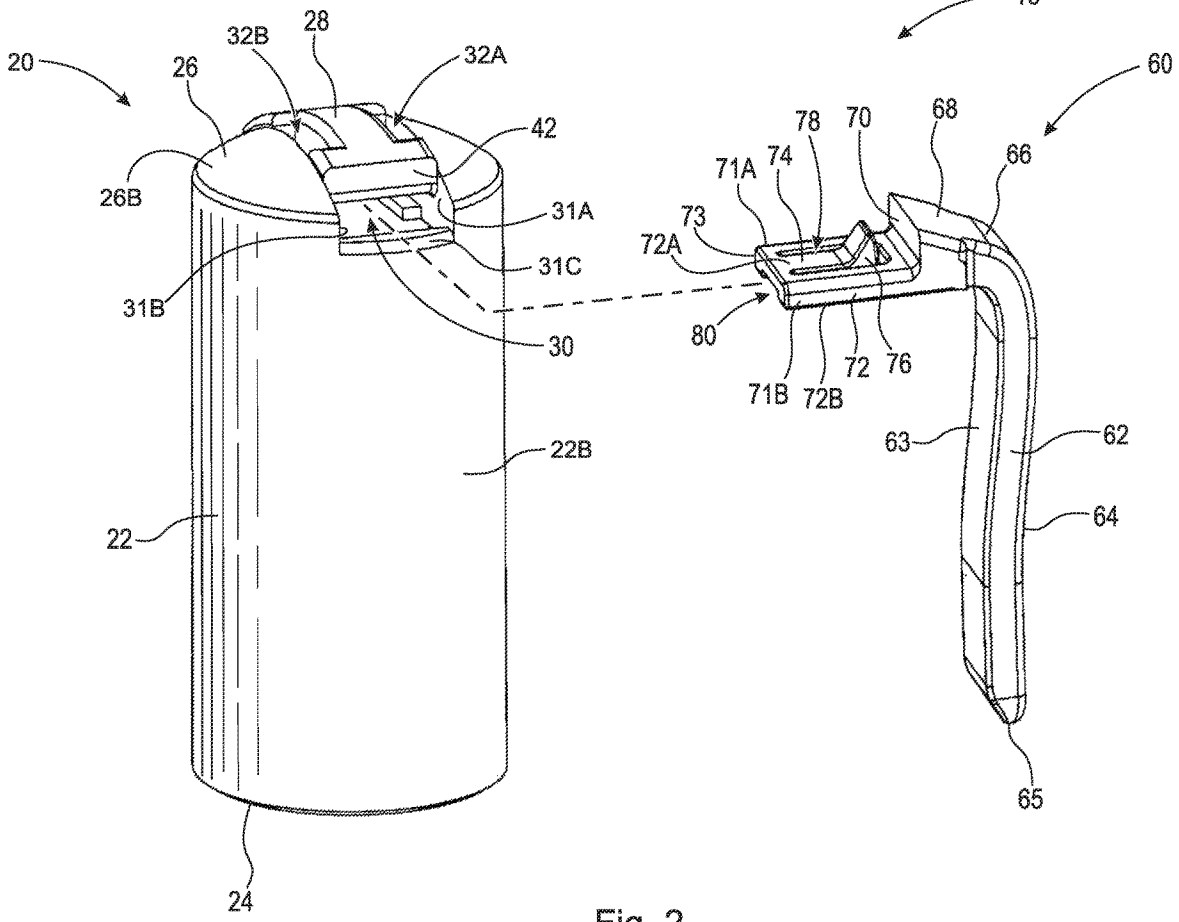
FIG. 2 is an exploded view of the clip cap assembly shown in FIG. 1.
Figure 3:
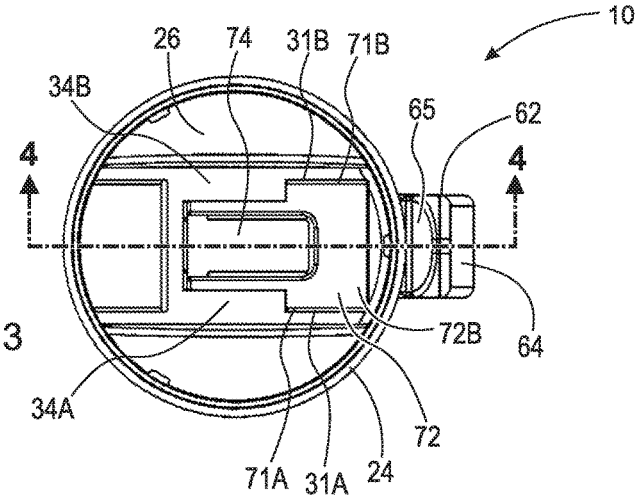
FIG. 3 is a bottom elevational view of the clip cap assembly shown in FIG. 1.
Figure 4:
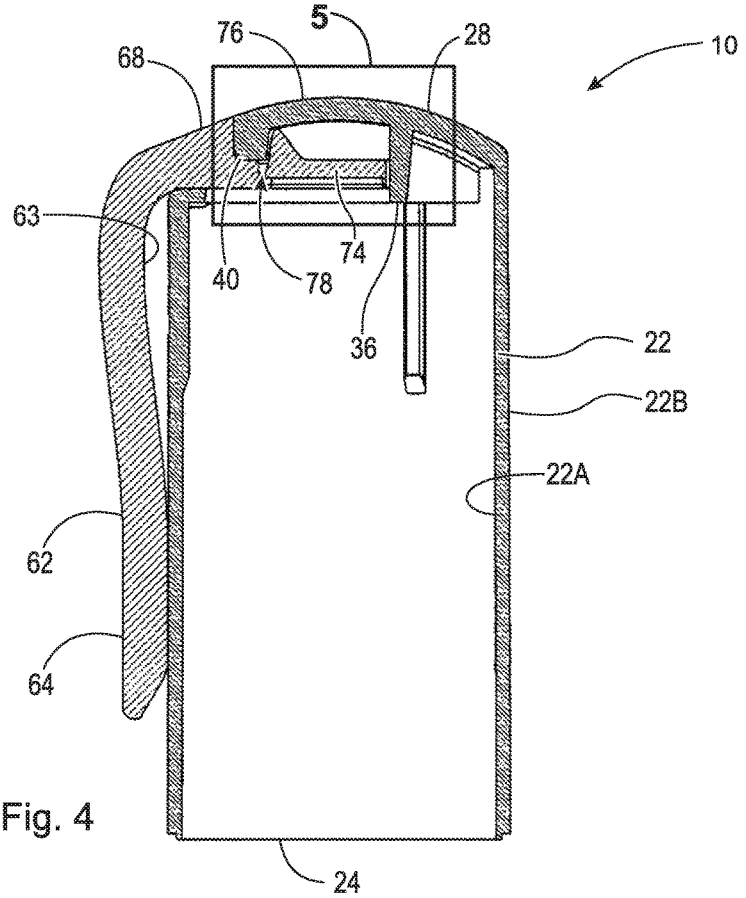
FIG. 4 is a cross-sectional view of the clip cap assembly taken generally along line 4-4 in FIG. 3.
Figure 5:
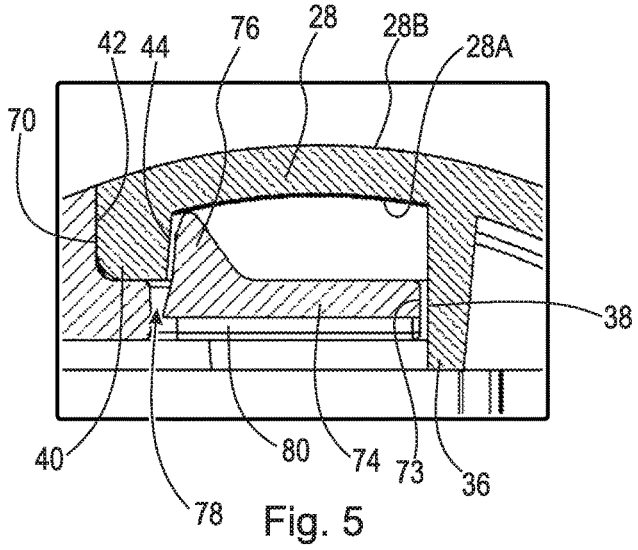
FIG. 5 is an enlarged view of the clip cap assembly taken generally of detail 5 in FIG. 4.

The following description should be viewed in light of FIGS. 1-13. Adverting now to the figures, FIG. 1 is a front perspective view of clip cap assembly 10. FIG. 2 is an exploded view of clip cap assembly 10. FIG. 3 is a bottom elevational view of clip cap assembly 10. FIG. 4 is a cross-sectional view of clip cap assembly 10 taken generally along line 4-4 in FIG. 3. FIG. 5 is an enlarged view of clip cap assembly 10 taken generally of detail 5 in FIG. 4. Clip cap assembly 10 generally comprises cap 20 and clip 60.

Figure 6:
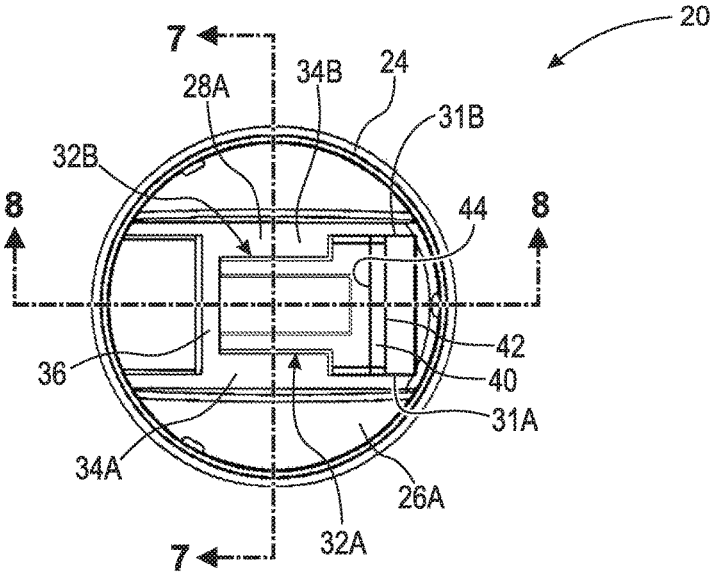
FIG. 6 is a bottom elevational view of the cap shown in FIG. 2.
Figure 8:
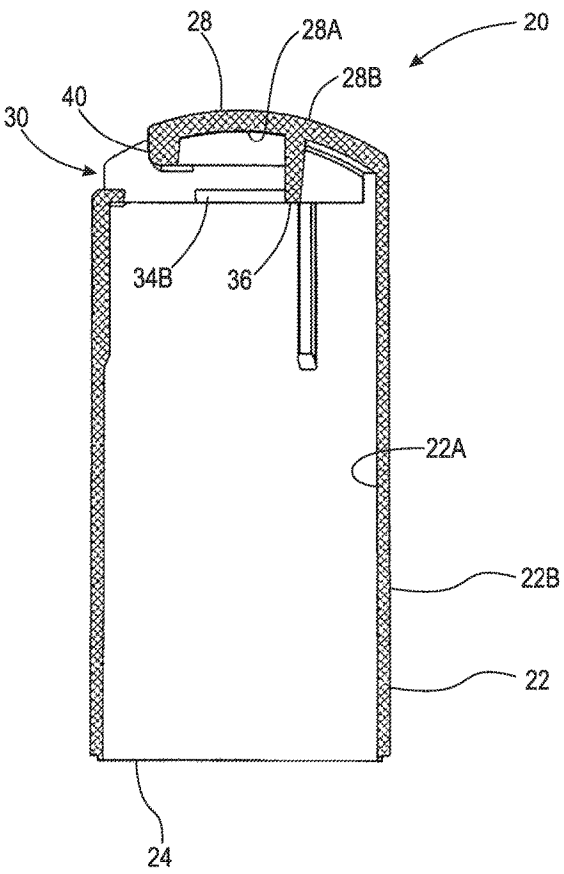
FIG. 8 is a cross-sectional view of the cap taken generally along line 8-8 in FIG. 6.
Figure 7:
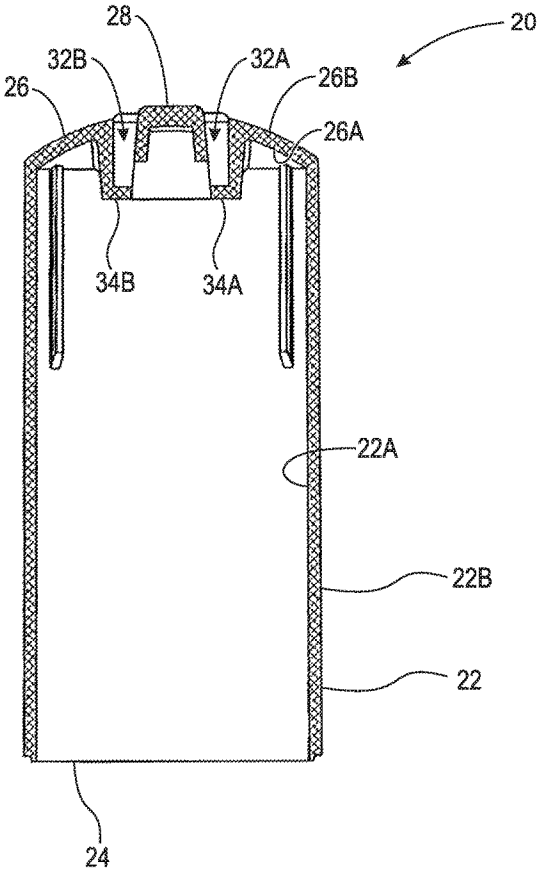
FIG. 7 is a cross-sectional view of the cap taken generally along line 7-7 in FIG. 6.

FIG. 6 is a bottom elevational view of cap 20. FIG. 7 is a cross-sectional view of cap 20 taken generally along line 7-7 in FIG. 6. FIG. 8 is a cross-sectional view of cap 20 taken generally along line 8-8 in FIG. 6.

Cap 20 comprises lateral side 22, bottom edge, top 26, and opening 30. Lateral side 22 has a substantially circular cross-section and comprises radially inward facing surface 22A and radially outward facing surface 22B. It should be appreciated, however, that lateral side 22 may have any cross-sectional geometry suitable for securing cap 20 to an aerosol canister, for example, a rectangular, square, or ovular cross-section. Cap 20 is arranged to be connected to an aerosol canister. In an example embodiment, cap 20 is slid onto an aerosol canister, opposite the nozzle, and is secured thereto via an interference fit (i.e., between the aerosol canister and radially inward facing surface 22A).

Figure 13:
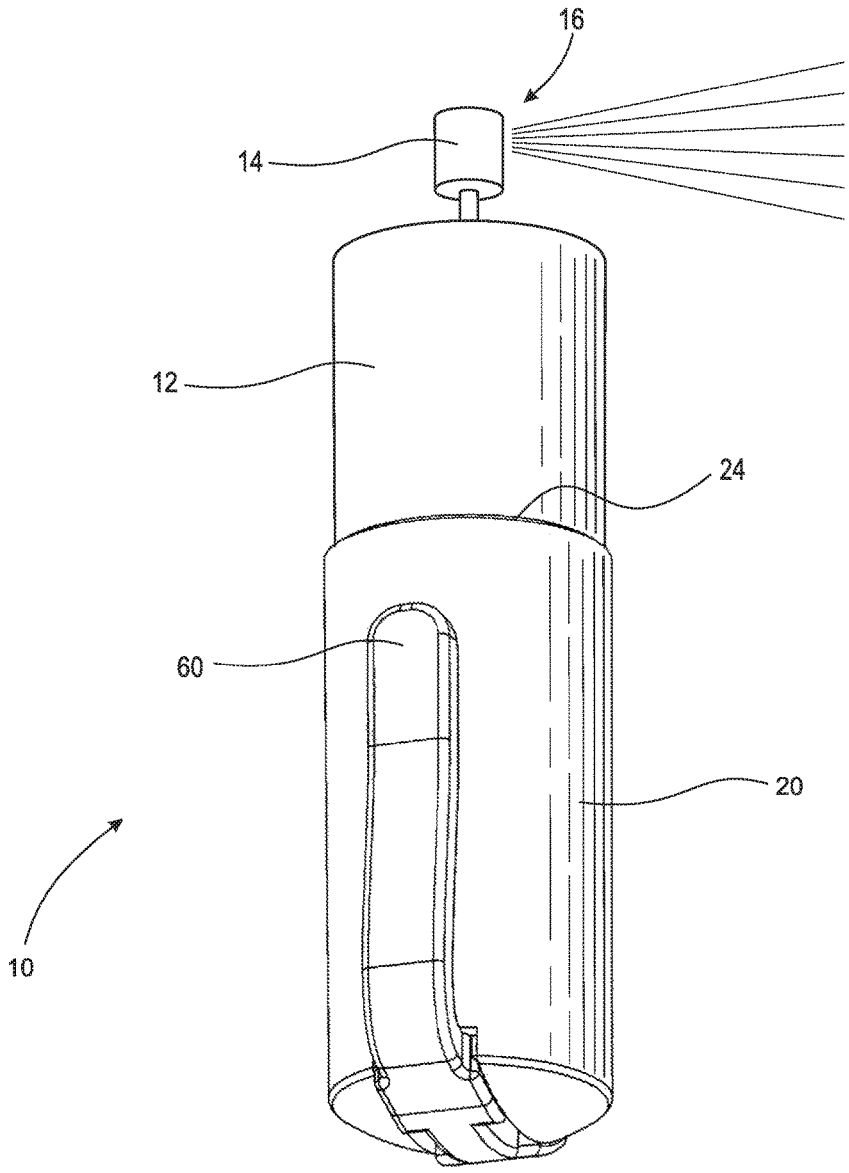

Top 26 may have a spherical curvature or any other suitable curvature for enclosing the bottom of an aerosol canister as shown in FIG. 13. In an example embodiment, top 26 is substantially planar. Top 26 comprises inward facing surface 26A and outward facing surface 26B. Top 26 further comprises protruding section 28, which includes inward facing surface 28A and outward facing surface 28B. Protruding section 28 further comprises apertures 32A and 32B. In an example embodiment apertures 32A and 32B extend from outward facing surface 28B to inward facing surface 28A.

Cap 20 further comprises flanges 36 and 40. Flange 36 extends downwardly from top 26 and/or protruding section 28, specifically from inward facing surface 26A and/or inward facing surface 28A, respectively. Flange 36 comprises surface 38. In an example embodiment, surface 38 is arranged substantially parallel to lateral side 22. In an example embodiment, surface 38 is arranged nonparallel to lateral side 22. Flange 36 further comprises rails 34A and 34B extending therefrom. Rails 34A and 34B are arranged substantially perpendicular to surface 38. In an example embodiment, rails 34A and 34B are arranged non-perpendicular to surface 38. In an example embodiment, one of rails 34A and 34B is arranged substantially perpendicular to surface 38 and the other of rails 34A and 34B is arranged non-perpendicular to surface 38.

Flange 40 extends downwardly from top 26 and/or protruding section 28, specifically from inward facing surface 26A and/or inward facing surface 28A, respectively. Flange 40 comprises abutting surface 42 and surface 44. In an example embodiment, surfaces 42 and 44 are arranged substantially parallel to lateral side 22. In an example embodiment, surfaces 42 and 44 are arranged nonparallel to lateral side 22. In an example embodiment, one of surfaces 42 and 44 is arranged substantially parallel to lateral side 22 and the other of surfaces 42 and 44 is arranged nonparallel to lateral side 22.

Opening 30 is arranged proximate top 26 and abutting surface 42. Opening 30 is generally a cutout in cap 20, comprising surfaces 31A, 31B, and 31C. Surface 31A is arranged substantially parallel to surface 31B. In an example embodiment, surfaces 31A and 31B are nonparallel. Surface 31C is arranged substantially perpendicular to surfaces 31A and 31B, and also connects surfaces 31A and 31B. In an example embodiment, surface 31C is non-perpendicular to surface 31A and 31B. In an example embodiment, surface 31C is substantially perpendicular to one of surfaces 31A and 31B and is non-perpendicular to the other of surfaces 31A and 31B. Surface 31C is arranged substantially coplanar with the top surfaces of rails 34A and 34C.

Figure 10:
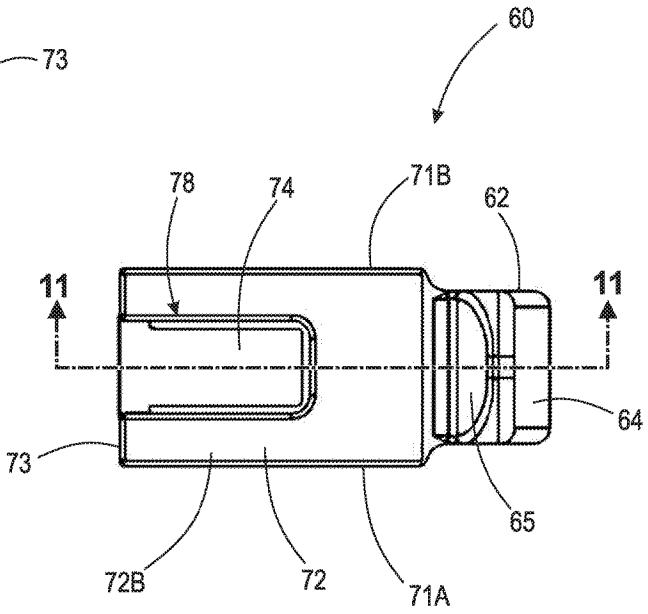
FIG. 10 is a bottom elevational view of the clip shown in FIG. 2.
Figure 9:
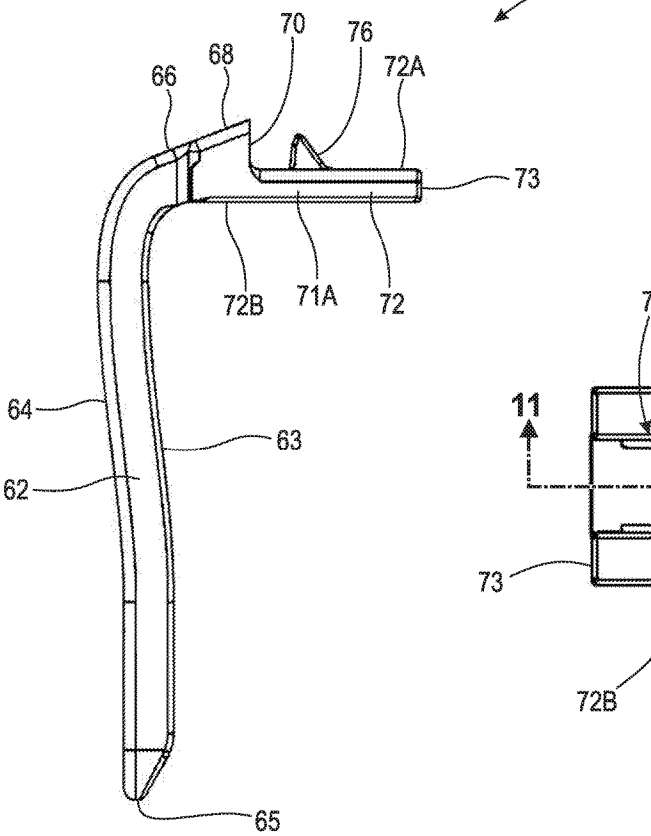
FIG. 9 is a side elevational view of the clip shown in FIG. 2.
Figure 12:
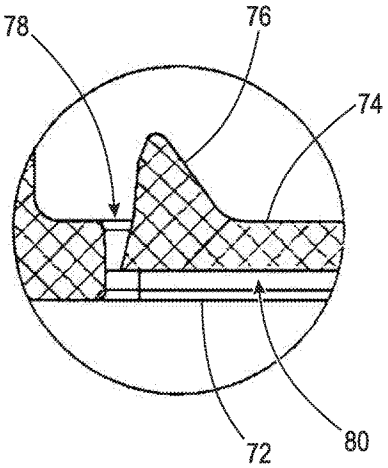
FIG. 12 is an enlarged view of the clip taken generally of detail 12 in FIG. 11; and, FIG. 13 is a perspective view of a clip cap assembly assembled on an aerosol canister.
Figure 11:
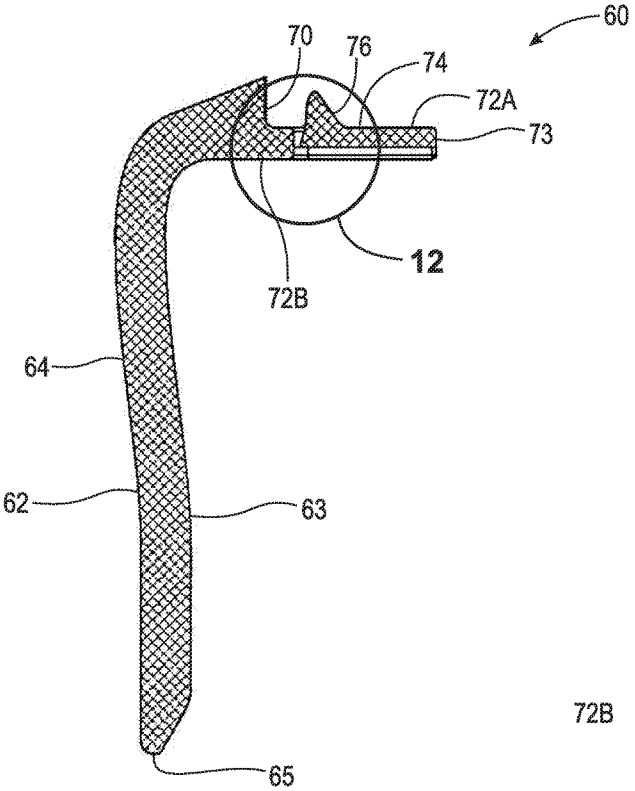
FIG. 11 is a cross-sectional view of the clip taken generally along line 11-11 in FIG. 10.

FIG. 9 is a side elevational view of clip 60. FIG. 10 is a bottom elevational view of clip 60. FIG. 11 is a cross-sectional view of clip 60 taken generally along line 11-11 in FIG. 10. FIG. 12 is an enlarged view of clip 60 taken generally of detail 12 in FIG. 11.

Clip 60 comprises arm 62 and plug 68. Arm 62 comprises end 65, end 66, surface 63, and surface 64. Plug 68 is connected to arm 62 at end 66 and extends therefrom. Plug 68 is arranged substantially perpendicular to arm 62. In an example embodiment, plug 68 is non-perpendicular to arm 62. When clip 60 is assembled to cap 20, surface 63 is directed toward radially outward facing surface 22B and surface 64 is arranged facing away from radially outward facing surface 22B.

Plug 68 comprises abutting surface 70 and prong 72. Prong 72 is substantially perpendicular to, and extends from, abutting surface 70. In an example embodiment, prong 72 is non-perpendicular to abutting surface 70. Prong 72 comprises side surfaces 71A and 71B, top surface 72A, bottom surface 72B, end 73, and tongue 74. Tongue 74 generally extends from end 73 (or from a point proximate end 73) towards abutting surface 70. Space 78 is arranged at least partially circumferentially around tongue 74 and extending from top surface 72A to bottom surface 72B, such that tongue 74 is displaceable, as will be discussed in greater detail below. Tongue 74 comprises protrusion 76 extending upwardly therefrom (i.e., extending upwardly from top surface 72A). Protrusion 76 comprises a triangular geometry. It should be appreciated, however, that protrusion 76 may comprise any geometry suitable to lock clip 60 within cap 20, such as rectangular, circular, ovular, etc. Prong 72 may further comprise channel 80 extending generally along bottom surface 72B from end 73 toward abutting surface 70. Clip 60, specifically arm 62, comprises a material that is elastically deformable. This allows arm 62 to deform when securing clip cap assembly 10 to an article of clothing, for example.

As shown in FIGS. 3-5, when clip 60 is assembled to cap 20, bottom surface 72B abuts against surface 31C and the top surfaces of rails 34A and 34B, and abutting surface 70 abuts against abutting surface 42. Additionally, protrusion 76 abuts against, or is arranged proximate to, surface 44, and end 73 abuts against, or is arranged proximate to, surface 38. Surface 63 abuts against, or is arranged proximate to, radially outward facing surface 22B.

When assembling clip 60 to cap 20, end 73 of prong 72 is inserted into opening 30. Bottom surface 72B is guided along surface 31C and guide rails 34A and 34B until protrusion 76 makes contact with abutting surface 42. As plug 68 is forced further into opening 30, tongue 74 elastically deforms downward such that protrusion 76 clears flange 40. When plug 68 is fully engaged within opening 30, tongue 74 returns to its original position (i.e., coplanar with top surface 72A) and protrusion 76 abuts against surface 44, thereby locking plug 68 within opening 30. Once plug 68 is fully engaged within opening 30, clip 60 is permanently secured to cap 20. In an example embodiment, once plug 68 is fully engaged within opening 30, clip 60 is removably secured to cap 20 (i.e., clip 60 can be removed from cap 20 and a replacement clip secured thereto).

FIG. 13 is a perspective view of clip cap assembly 10 assembled on aerosol canister 12. As shown, the bottom of aerosol canister 12 is inserted into cap 20 and is snugly secured therein. When clip cap assembly 10 is secured to aerosol canister 12 bottom edge 24 is arranged on aerosol canister so as not to interfere with actuator 14 or nozzle 16. Clip 60 can engage, for example, the user's pocket. When needed, the user can quickly grab aerosol canister 12 by disengaging clip 60 and empty the contents therein.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A clip cap assembly for securing an aerosol canister, comprising:
- a cap, including:
  - a top;
  - a lateral side connected to the top and having a radially inward facing surface arranged to engage the aerosol canister;
  - an opening arranged at least partially in the top;
  - a first flange extending downwardly from the top and forming a first surface in the opening; and,
  - a second flange extending downwardly from the top; and,
- a clip, including:
  - an arm having a first end and a second end; and,
  - a plug extending from the second end and engaged in the opening, the plug having:
    - a second surface arranged proximate the first surface; and,
    - a prong including a top surface, a bottom surface, an end surface, and a flexible tongue, wherein the flexible tongue is arranged between the first and second flanges.

2. The clip cap assembly as recited in Claim 1, wherein a space at least partially surrounds the flexible tongue.

3. The clip cap assembly as recited in claim 2, wherein the flexible tongue comprises a protrusion extending therefrom.

4. The clip cap assembly as recited in claim 3, wherein the first flange further comprises a third surface, the protrusion arranged proximate the third surface.

5. The clip cap assembly as recited in claim 1, wherein the opening further comprising a first guide surface, the bottom surface abutting against the first guide surface.

6. The clip cap assembly as recited in claim 5, wherein the cap further comprises at least one guide rail, the bottom surface abutting against the at least one guide rail.

7. The clip cap assembly as recited in claim 1, wherein the end surface is arranged proximate the fourth surface.

8. The clip cap assembly as recited in claim 1, wherein the top further comprises at least one aperture.

9. The clip cap assembly as recited in claim 1, wherein the top further comprises a protruding section.

10. The clip cap assembly as recited in claim 9, wherein the protruding section further comprise at least one aperture.

11. The clip cap assembly as recited in claim 1, wherein the top has a spherical curvature.

12. The clip cap assembly as recited in claim 1, wherein the first surface abuts against the second surface.

13. A clip cap assembly for securing an aerosol canister, comprising:
- a cap, including:
  - a top;
  - a lateral side connected to the top and having a radially inward facing surface arranged to engage the aerosol canister; and,
  - an opening having a first surface; and,
- a clip, including:
  - an arm having a first end and a second end; and,
  - a plug extending from the second end and engaged in the opening, the plug having:
    - a second surface arranged proximate the first surface; and,
    - a prong including a top surface, a bottom surface, an end surface, and a flexible tongue, wherein a space extending from the top surface to the bottom surface at least partially surrounds the flexible tongue.

14. The clip cap assembly as recited in claim 13, wherein the cap further comprises a flange extending downwardly from the top.

15. The clip cap assembly as recited in claim 14, wherein the flexible tongue comprises a protrusion that engages the flange.

16. The clip cap assembly as recited in claim 13, wherein the opening further comprising a first guide surface, the bottom surface abutting against the first guide surface.

17. The clip cap assembly as recited in claim 16, wherein the cap further comprises at least one guide rail, the bottom surface abutting against the at least one guide rail.

18. The clip cap assembly as recited in claim 13, wherein the cap further comprises a second flange extending downwardly from the top and forming a fourth surface, the end surface arranged proximate the fourth surface.

* * * * *